US005561280A

United States Patent [19]

Blatter

[11] Patent Number: 5,561,280

[45] Date of Patent: Oct. 1, 1996

[54] COMPRESSED GAS-BLAST CIRCUIT BREAKER

[75] Inventor: Johannes Blatter, Gretzenbach, Switzerland

[73] Assignee: Gec Alsthom T&D AG, Oberentfelden, Switzerland

[21] Appl. No.: 441,455

[22] Filed: May 15, 1995

[30] Foreign Application Priority Data

Jun. 20, 1994 [EP] European Pat. Off. ..... 94109470

[51] Int. Cl.[6] ..... H01H 33/91

[52] U.S. Cl. ..... 218/59; 218/62; 218/66; 218/84

[58] Field of Search ..... 218/43, 57–67, 218/68–80, 83, 84, 86, 88

[56] References Cited

U.S. PATENT DOCUMENTS

| | | | |
|---|---|---|---|
| 4,000,387 | 12/1976 | Milianowicz | 218/61 |
| 4,059,741 | 11/1977 | Yoshioka et al. | 218/60 |
| 4,329,553 | 5/1982 | Graf | 218/59 |
| 4,568,806 | 2/1986 | Frink | 218/57 |
| 5,248,862 | 9/1993 | Blatter | 218/62 |
| 5,304,762 | 4/1994 | Hiltbrunner | 218/62 |

FOREIGN PATENT DOCUMENTS

| | | | |
|---|---|---|---|
| 0475270 | 3/1992 | European Pat. Off. | H01H 33/91 |
| 2354625 | 1/1978 | France | H01H 33/90 |
| 2435795 | 4/1980 | France | H01H 33/90 |
| 2914033 | 3/1980 | Germany | H01H 33/91 |
| 2934082 | 3/1981 | Germany | H01H 33/82 |
| 3438635 | 4/1986 | Germany | H01H 33/1915 |
| 3942489 | 6/1991 | Germany | H01H 33/915 |

*Primary Examiner*—J. R. Scott

*Attorney, Agent, or Firm*—Jacobson, Price, Holman & Stern, PLLC

[57] ABSTRACT

A compressed gas-blast circuit breaker including a pump cylinder which is moved along with a movable first contact piece. The pump cylinder surrounds a pumping space and a blast chamber, the latter of which is fluidly connected to a first blast nozzle surrounding the first contact piece. A pump piston is supported on a fixed support part via toggle levers, and a toggle joint of the toggle levers is pivoted to a drive rod via a rocker. At the start of a switch-off stroke, an initial bent position of the toggle lever is lessened, intensified after the straightened position has been passed, then lessened again and intensified again after the straightened position has been passed once more. The oscillation of the toggle lever about the straightened position permits the pump piston to be virtually stationary, while an intermediate bottom, which separates the pumping space from the blast chamber, approaches the pump piston in order to reduce the pumping volume. As a result, arc extinguishing gas is pumped into the blast chamber through a nonreturn valve from the pumping space in order to generate blast pressure. Subsequently, the pump piston is moved in the same sense as the pump cylinder until the switched-off position is reached. The pump piston is positively guided during switching off and also during switching on.

13 Claims, 2 Drawing Sheets

COMPRESSED GAS-BLAST CIRCUIT BREAKER

BACKGROUND OF THE INVENTION

The present invention relates to a compressed gas-blast circuit breaker having two coaxially arranged contact pieces which engage one another in a switched-on position, as well as a blast nozzle and pump cylinder for pumping arc extinguishing gas.

A compressed gas-blast circuit breaker of this type is disclosed in German patent document 3,942,489. Its pump cylinder, which is moved along with a movable first contact piece, surrounds a constant-volume blast chamber and a pumping space which is likewise surrounded by the pump cylinder and is connected to the blast chamber via a non-return valve. The pumping volume of the pumping space can be reduced upon switching off by means of a piston arranged in the pump cylinder in order to pump arc extinguishing gas into the blast chamber through the non-return valve for the purpose of building up blast pressure. During a switch-off stroke, the pump piston is retained by a toggle lever blocked in a straightened position in a position of such a dimension that the pumping volume vanishes when the minimum distance required between the contact pieces for the arc extinguishment is reached. Directly after this contact position has been reached, the lock is released, with the result that the pump piston can move together with the pump cylinder in the switching-off direction until the movable first contact piece has reached the switched-off position. Upon switching on, the underpressure built up in this case in the pumping space draws the pump piston in the direction of the switching-on movement until the toggle lever is again located in the straightened position and is locked there again. A ventilating valve in the pump piston must be spring-loaded for this purpose in such a way that it does not open until after the locked position has been reached, in order to fill the pumping volume again witch arc extinguishing gas. In this known compressed gas-blast circuit breaker, the return of the pump piston into the locked position is not ensured upon switching on. If, for any reason, for example increased friction, the forces necessary for this purpose increase, the ventilating valve can open prematurely. In this switched-on position of the compressed gas-blast circuit breaker the pump piston can then be located in an arbitrary, non-locked position, and the consequence of this is that when switching off is next performed no blast pressure has built up during separation of the contact pieces. Since the ventilating valve has to be spring-loaded, there is always a corresponding difference present between the pressure in the pumping volume and the pressure in the surrounding space even when switching on. This requires additional drive energy.

Furthermore, German patent document 3,942,489 discloses a compressed gas-blast circuit breaker with a pump cylinder surrounding only a pumping space. In order to have the driving force available at the start of a switch-off stroke, as it were, exclusively for accelerating the moving circuit breaker parts, and not to use it with the compression of the arc extinguishing gas until towards the end of a stroke segment, that is to say when the moving circuit breaker parts are already in motion, the pump piston is moved in the same sense as the pump cylinder at the start of the switch-off stroke. Subsequently, for the purpose of quickly compressing the arc extinguishing gas in order to enable powerful blasting of the arc, the direction of movement of the reciprocating piston is reversed so that it moves in the opposite sense to the pump cylinder. After a repeated reversal of a direction of movement, it finally moves again in the same sense as the pump cylinder. In order to control the pump piston, the latter is supported by a toggle lever which is controlled by a rocker which is pivoted at one end to the toggle joint and at the other end to a point which is moved along with the movable contact piece. At the start of the switch-off stroke, the rocker presses the toggle joint outwards, as a result of which the bent position, already present in the switched-on position, of the toggle lever is further intensified. In this case, the pump piston moves in the same sense as the pump cylinder. Subsequently, the rocker draws the toggle joint inwards, as a result of which the bent position is reduced. As a result, the pump piston moves in the opposite sense to the pump cylinder until the toggle lever is completely straightened, in order to quickly compress the arc extinguishing gas. After the straightened position has been passed, the bend is intensified again, as a result of which the pump piston is moved in the same sense as the pump cylinder. The pump piston is located approximately in the same position both in the switched-on and in the switched-off position of the movable contact piece.

A further compressed gas-blast circuit breaker includes a pump cylinder which is moved along with the movable contact piece and has both a blast chamber and a pumping space connected to the latter via a non-return valve, as disclosed in German patent document 3,942,489. In order to pump arc extinguishing gas from the pumping space into the blast chamber in order to build up the blast pressure at the start of a switch-off stroke, the blast piston, which together with the blast cylinder delimits the pumping space, is restrained by a parallelogram-type linkage and a contour, acting as a slotted link, of the movable contact piece, and is unlocked after this contact piece has traversed a stroke segment, with the result that it can move in the same sense as the pump cylinder. A spring acts between the pump cylinder and the pump piston in order to increase the pump volume again upon switching on. Loading the spring at the same time as compressing the arc extinguishing gas requires increased driving force and considerable drive energy. Moreover, upon switching on, the blast piston can be carried along with the blast cylinder as a consequence of friction, with the result that compression of the arc extinguishing gas is no longer possible at the next switching off.

SUMMARY OF THE INVENTION

It is therefore an object of the present invention to provide a compressed gas-blast circuit breaker of the generic type which ensures a reliable build up of blast pressure in conjunction with a low requirement for drive energy.

This object is achieved by providing a compressed gas-blast circuit breaker having first and second coaxially arranged contact pieces which engage one another in a switched-on position. The first contact piece is movable in an axial direction and is surrounded by a blast nozzle. The blast nozzle is penetrated by the second contact piece and is arranged on a pump cylinder which moves along with the first contact piece. The blast nozzle is fluidly connected to a blast chamber of constant volume. The blast chamber, in turn, contains arc extinguishing gas surrounded by the pump cylinder. Also included is a pumping space which is surrounded by the pump cylinder and is fluidly connected to the blast chamber via a nonreturn valve. The nonreturn valve permits gas to flow from the pumping space to the blast chamber, but not vice versa. The pumping space has a volume which is variable by a pump piston. The pump piston is arranged in the pump cylinder such that upon movement of the first contact piece through a stroke segment of a switch-off stroke beginning at the switched-on position and ending at least approximately at a contact-separating position causes arc extinguishing gas to be pumped through the nonreturn valve into the blast chamber for the purpose of building up blast pressure.

The compressed gas-blast circuit breaker further comprises at least one toggle lever, each having a first member and a second member. The first member is pivotally connected to the pump piston, while the second member is pivotally connected to a stationary support. The first and second members are pivotally interconnected at a toggle joint in such a way that during a switch-off stroke, the pump piston initially remains substantially stationary for the purpose of reducing the volume of the pumping space and thereafter moves in the same direction as the pump cylinder.

The at least one toggle lever is guided by at least one guide member which, in turn, is coupled to the movable first contact piece such that in the course of the switch-off stroke, the toggle lever is initially straightened from an inwardly bent position to a straightened position, then bent from the straightened position to an outwardly bent position, then straightened back to said straightened position and bent inwardly again.

According to a preferred embodiment, the toggle lever is arranged such that the straightened position is achieved for a second time during each switch-off stroke at approximately when the contact-separating position is achieved.

According to another embodiment, the guide member is a rocker having one end pivotally connected to a point which moves along with the first contact piece, and another end pivotally connected to the toggle lever. Preferably, the rocker is pivotally connected to the toggle joint of the toggle lever.

According to yet another embodiment, an active length of the rocker is shorter than an overlapping length of the first and second contact pieces when in the switched-on position. Preferably, the active length of the rocker is 0.6 to 0.8 times the overlapping length, and an active length of the second member of the toggle lever is 1.2 to 1.6 times larger than the active length of the rocker.

In yet another embodiment, an active length of the first member of the toggle lever is at least twice the active length of the rocker.

Preferably, the at least one toggle lever and at least one guide member actually comprise four toggle levers and guide members.

According to yet another embodiment, the straightened position of the toggle lever extends at least approximately parallel to the axial direction. In addition, an internal diameter of a narrowest portion of the blast nozzle preferably corresponds at least approximately to an outer diameter of a segment of the second contact piece; which penetrates the narrowest portion in the switched-on position in order to close the blast nozzle. Preferably, upon traversing the stroke segment, the volume of the pumping space is reduced to approximately zero.

According to the invention, the movement of the pump piston is positive both in the case of a switch-off stroke and in the case of a switch-on stroke. The controlled swinging to and fro of the toggle joint about the straightened position keeps the pump piston approximately stationary, while the pump cylinder together with the movable first contact piece traverses a substantial stroke segment at the start of a switch-off stroke in order to generate blast pressure. In particular, the stroke segment begins in the switch-on position and ends at least approximately at the contact-separating position. In an advantageous way, the pump piston is kept approximately stationary until shortly after the contact-separating position is reached. This is so, for example, approximately up to a position of the first movable contact piece which corresponds to an extinguishing distance which is at least required for the arc extinguishment. As a consequence of the high insulating capacity of the pressurized gas, this extinguishing distance is particularly small for small currents in the case of compressed gas-blast circuit breakers. After the traversal of this stroke segment, the pump piston is moved in the direction towards the switched-off position approximately at the same speed as or at a higher speed than the pump cylinder. As a consequence of the blast pressure in the blast chamber, which is generated by the reduction in the pumping volume, it is ensured that small currents are switched off in the case of small extinguishing distances. Since the reduction in the pumping volume is terminated approximately upon separation of the contact pieces, the large blast pressure, generated as a consequence of the influence of an arc when high currents are switched off in the blast chamber cannot react on the drive of the compressed gas-blast circuit breaker. It is possible as a result to manage with less drive energy.

BRIEF DESCRIPTION OF THE DRAWINGS

The invention is now explained in more detail with the aid of an exemplary embodiment represented in the drawing in which, purely diagrammatically,.

DETAILED DESCRIPTION OF A PREFERRED EMBODIMENT

Figure 1:
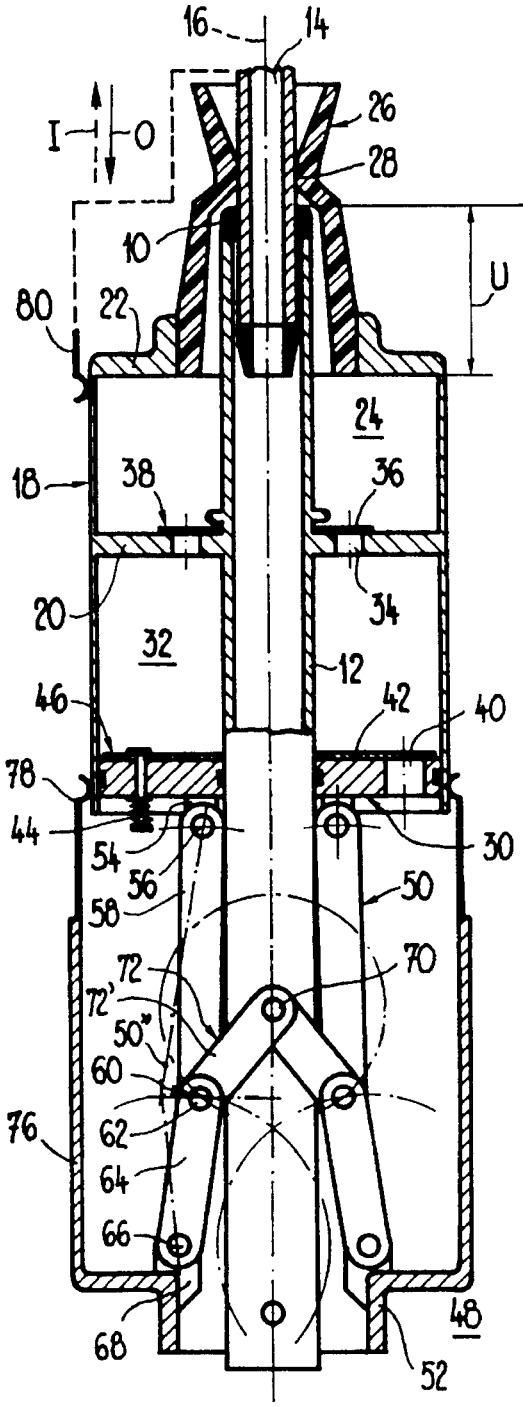
FIG. 1 shows a longitudinal section through a part of a compressed gas-blast circuit breaker according to the invention, in a switched-on position.

The compressed gas-blast circuit breaker represented in FIGS. 1–4 has a movable first contact piece 10 which is seated on a drive rod 12 which can be displaced at the upper end by means of a drive mechanism (not shown) in the sense of the arrow O for switching off, and vice versa in the sense of the arrow I for switching on. The first contact piece 10 cooperates with a fixed, tubularly constructed second contact piece 14 which, in the switched-on position of the compressed gas-blast circuit breaker shown in FIG. 1, penetrates the annularly constructed first contact piece 10 and engages the inside of the tubular drive rod 12. The overlapping of the: two coaxially arranged contact pieces 10, 14 in the direction of the circuit breaker axis 16 is denoted by U.

The drive rod 12 is surrounded at a radial distance by a pump cylinder 18. The pump cylinder 18 is fastened to the drive rod 12 by means of an intermediate bottom 20 arranged at right angles to the circuit breaker axis 16. Integrally formed on the end of the pump cylinder 18 facing the first contact piece 10 is a cylinder bottom 22 which is separated from the intermediate bottom 20 and encloses together with the intermediate bottom 20 and the pump cylinder 18, a blast chamber 24 which has a constant volume. Fastened to the cylinder bottom 22 is a blast nozzle 26 which surrounds the first contact piece 10 and is fluidly connected to the blast chamber 24.

At its narrowest point 28, the blast nozzle 26 has an inside cross-section which approximately corresponds to the outside diameter of the second contact piece 14. As a result, upon switching off the compressed gas-blast circuit breaker only a little or no arc extinguishing gas can escape between the second contact piece 14 and the blast nozzle 26 until the narrow point 28 has run off the second contact piece 14. This contributes to accumulating a high blast pressure in the blast chamber 24.

Arranged in the pump cylinder 18 on the side of the intermediate bottom 20 opposite the blast chamber 24 is an annular pump piston 30 which is circumferentially guided in a sliding but gas-tight fashion along the inner lateral surface of the pump cylinder 18 and is internally guided along the outer lateral surface of the drive rod 12. Together with the pump cylinder 18 and the intermediate bottom 20, the pump piston 30 delimits a pumping space 32. The intermediate bottom 20 has passages 34 which fluidly connect the pumping space 32 to the blast chamber 24 and are closed by means of a valve plate 36 which is arranged on the arcing-chamber side and is movable in the direction of the circuit breaker axis 16 over a limited travel distance. Together with this cylinder bottom 20, the valve plate 36 forms a nonreturn valve 38 which facilitates fluid passage in a direction from the pumping space 32 into the blast chamber 24.

Ventilating passages 40 in the pump piston 30, which extend in the direction of the circuit breaker axis 16, are covered on the pumping-space side by a ventilating-valve plate 42 which is held preloaded in the closed position by means of springs 44. The ventilating valve 46 formed by the pump piston 30 and the ventilating-valve plate 42 serve the purpose of filling up the pumping space 32 with arc extinguishing gas when the latter is under pressurized with reference to the surrounding space 48. This is the case, in particular, upon switching on the compressed gas-blast circuit breaker. For the sake of completeness, it may be mentioned that the parts of the compressed gas-blast circuit breaker which are shown in FIGS. 1–4 are arranged, in a way generally known, in a tight circuit breaker housing (not shown) bounding the surrounding space 48.

Figure 4:
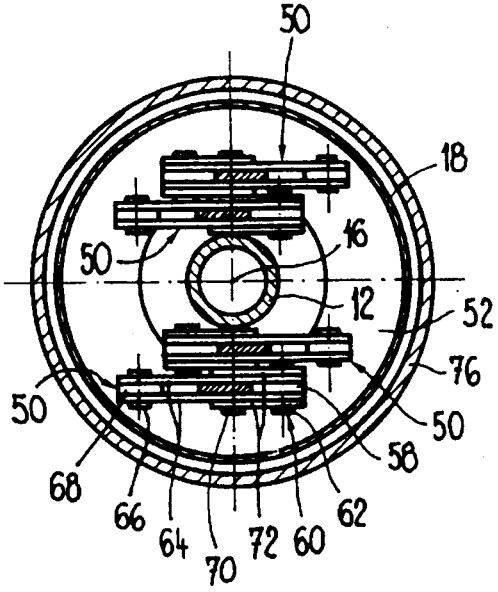
FIG. 4 shows a section along the line IV—IV through the illustrated part of the compressed gas-blast circuit breaker.

As also emerges, in particular, from FIG. 4, the pump piston 30 is supported on a fixed support part 52 by four toggle levers 50 moving in parallel planes of motion. Two of the toggle levers 50 are arranged in each case on opposite sides of the drive rod 12 in a fashion which is offset but equal and opposite with respect to a plane extending in the direction of the circuit breaker axis 16 and at right angles to the planes of motion, with the result that the relevant toggle levers 50 can pass by one another.

Constructed for each toggle lever 50 on the side of the pump piston 30 opposite from the pumping space 32 is a bearing eye 54 to which the free end of a first member 58, of fish-plate type, of the respective toggle lever 50 is pivoted by means of a fulcrum stud 56. The toggle joint 60 on the other end of the first member 58 is provided with a fulcrum stud 62 to which a first end of the second member 64 of the toggle lever 50, which is constructed as a double fish-plate, is pivoted. The opposite end of this second member 64 is pivoted by means of a further fulcrum stud 66 to a bearing eye 68 which is fastened to, or integrally formed on, the support part 52 and is thus immovable.

The drive rod 12 is penetrated by a joint shaft 70, to which in each case there is pivoted at one end a rocker 72' which is of the type of a double fish-plate. The rocker 72' thus forms a guide member 72 and is pivotally connected at an opposite end to the fulcrum stud 62 of the toggle joint 60.

Measured from the axis of the joint shaft 70 to the axis of the fulcrum stud 62, the active length of the rocker 72' is shorter than the overlap U of the two contact pieces 10, 14 in the switched-on position of the compressed gas-blast circuit breaker. The active length of the rocker 72' is preferably 60 to 80% of the overlap U.

The active lengths of the first and second members 58, 64 are larger than that of the rocker 72'. The active length of the first member 58 is substantially larger, preferably more than twice as long, as the active length of the rocker 72', the active length of the second member 64 preferably being 1.2 to 1.6 times larger than that of the rocker 72'.

Figure 2:
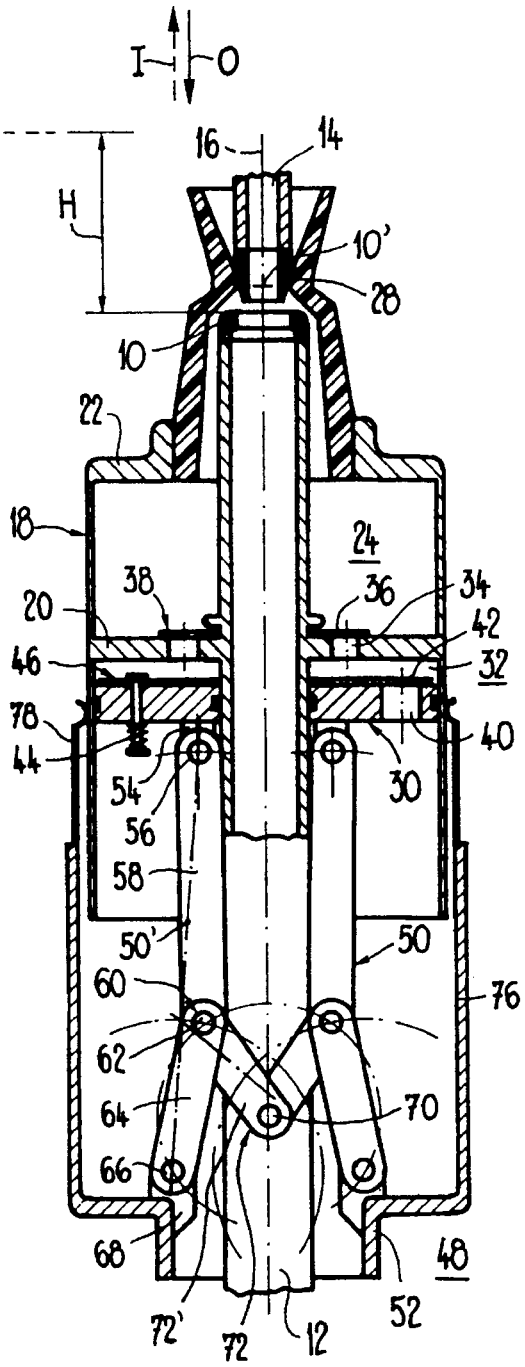
FIG. 2 shows in the same representation as FIG. 1 the compressed gas-blast circuit breaker shortly after separation of the two contact pieces.
Figure 3:
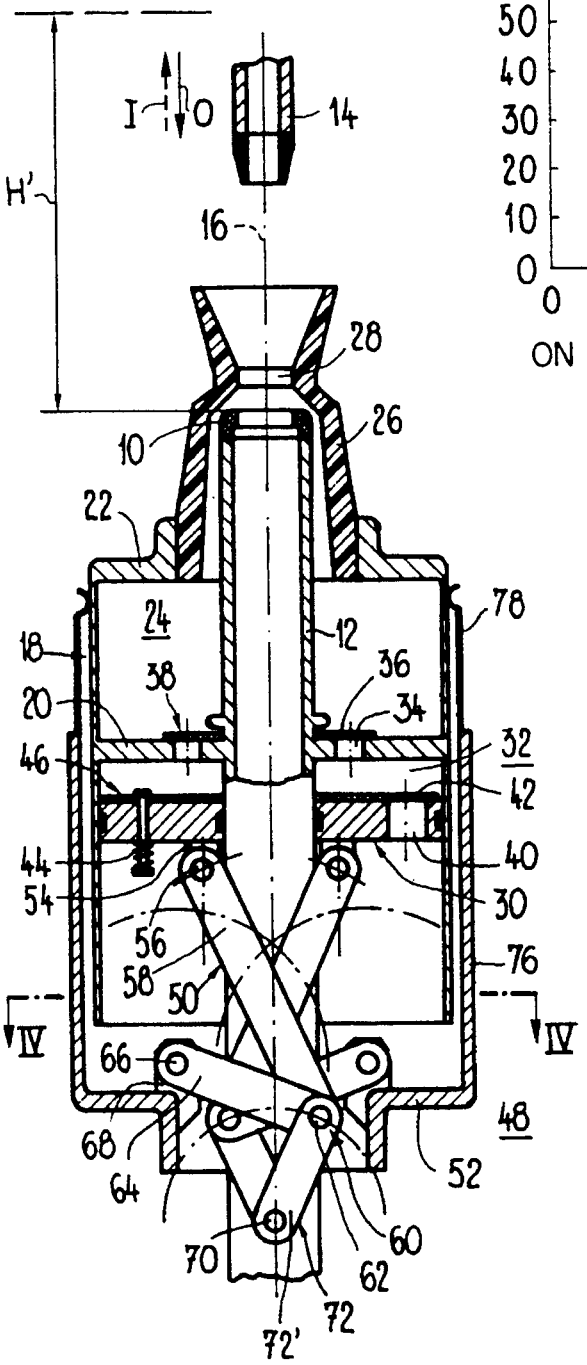
FIG. 3 shows the compressed gas-blast circuit breaker of FIGS. 1 and 2, but in a switched-off position.

As may be seen, in particular, from FIGS. 1–3, measured in the plane of the drawing, which is parallel to the planes of motion of the toggle levers, the fulcrum studs 56 arranged on the pump piston 30 are located at a somewhat smaller distance relative to the circuit breaker axis 16 than the fulcrum studs 66 arranged on the support part. The straightened position of the toggle lever 50, which is indicated in FIG. 2 by the dashed and dotted line 50' is thus at a small acute angle of a few, for example 4° relative to the circuit breaker axis 16. However, this angle can also be somewhat larger, for example up to 10°, or 0°, with the result that the straightened position 50' extends parallel to the circuit breaker axis 16. Finally, it is also conceivable to arrange the fulcrum studs 66 nearer to the circuit breaker axis 16 than the fulcrum studs 56.

As FIG. 1 shows, in the switched-on position of the compressed gas-blast circuit breaker, the toggle levers 50 are located in a slightly inwardly bent position, the rockers 72' being approximately at right angles to one another.

FIG. 2 shows the compressed gas-blast circuit breaker during a switch-off stroke shortly after separation of the contact pieces 10, 14, the first members 58 of the toggle levers 50 assuming a position parallel to the circuit breaker axis 16. As is easy to see from a comparison with FIG. 1, in this case the pump piston 30 is in a roughly identical position as in the case of the switched-on compressed gas-blast circuit breaker, it being the case, however, that the first contact piece 10 has moved together with the circuit breaker parts moved along their width by a stroke segment H in the direction of the arrow O. As a consequence of this relative movement between the pump piston 30 and the intermediate bottom 20 of the pump cylinder 18, the volume of the pumping space 32 has been substantially reduced in this case and diminished approximately to zero. By contrast with the position in FIG. 1, where the two corresponding rockers 72' are pointing upward in an arrow-like manner, in FIG. 2 they assume a position pointing downward in an arrow-like manner.

Indicated in FIG. 2 by means of 10' is that position of the movable first contact piece 10 which it assumes when the toggle levers 50 are located in the straightened position 50'. In this position, approximately, the two contact pieces 10, 14 are separated electrically from one another.

In FIG. 3, the movable first contact piece 10 is located at the end of a switch-off stroke. The travel covered from the switched-on position to the switched-off position is indicated by the double arrow H'. As shown by comparison with FIG. 2, the stroke segment H is smaller than half the travel H'. It is, for example, approximately 40% of the travel H'.

As may further be seen from FIG. 3, during the motion of the first contact piece 10 from the position shown in FIG. 2 to the switched-off position shown in FIG. 3 the volume of the pumping space 32 has changed insubstantially. In the course of this movement, the toggle levers 50 have moved into a pronounced bent position in which they cross over one another.

Integrally formed on the support part 52 is the conductor part 76 whose inside diameter is larger than the outside diameter of the pump cylinder 18, with the result that in the course of a switch-off stroke the latter can drop in a contactless fashion into the conductor part 76. Arranged on the free end of the conductor part 76 is a crown-like sliding contact piece 78 which slides on the outer lateral surface of the pump cylinder 18 in order to maintain the electrical connection between the support part 52 which is connected to a first circuit breaker terminal (now shown), and pump cylinder 18. The first contact piece 10 is connected in an electrically conductive fashion to the pump cylinder 18 via the drive rod 12 and the intermediate bottom 20. Furthermore, in the switched-on position of the compressed gas-blast circuit breaker a continuous-current contact piece 80 which is also constructed like a crown and is connected to the second contact piece 14 cooperates with the pump cylinder 18 (FIG. 1). This continuous-current contact piece 80 and the second contact piece 14 are connected in a known way to a second circuit breaker terminal. In the switch-on position, the larger current component flows through the continuous-current contact piece 80, and a smaller current component flows through the contact pieces 10 and 14 to the pump cylinder 18 and from there through the sliding contact piece 78 and the conductor part 76 to the support part 52. In the event of a switch-off stroke, the pump cylinder 18 separates from the continuous-current contact piece 80 before the contact pieces 10 and 14 part from one another. As a consequence of this, the entire current is commutated virtually without an arc into the current path having the two contact pieces 10 and 14.

Figure 5:
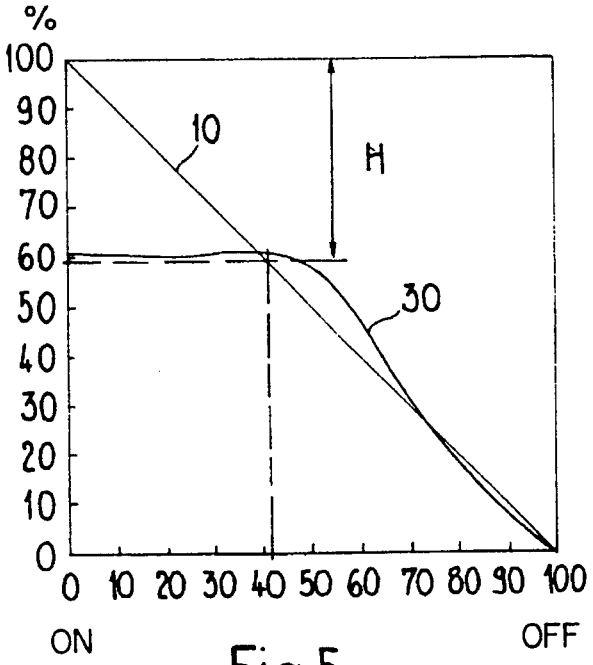
FIG. 5 shows a diagram from which the movement of the pump piston emerges as a function of the movement of the movable first contact piece and the pump cylinder moved along with the first contact piece.

FIG. 5 shows the movement of the pump piston 30 (line 30) as a function of the movement of the first contact piece (line 10). The switched-on position of the first contact piece 10 is shown at O on a scale on the abscissa, and the switched-off position is shown at 100. The ordinate gives the travel in per cent. It may be seen from this that the pump piston 30 remains virtually stationary, while the first contact piece 10 traverses the stroke segment H. In the example shown, this stroke segment H is approximately 40% of the entire switch-off stroke. The pump piston 30 then moves in the region adjoining the stroke segment H in the same sense and at approximately the same speed as the first contact piece 10 and the pump cylinder 18, until the switched-off position is reached.

Starting from the switched-on position shown in FIG. 1, at the start of a switched-off stroke the rockers 72' knock the toggle levers 50 out of their slightly bent position into the straightened position 50' and beyond the latter into an outwardly bent position, which is indicated in FIG. 1 by dots and dashes and designated 50". This is reached when the rockers 72' are at right angles to the circuit breaker axis 16. In the course of the further movement of the first contact piece 10 to the end of the stroke segment H, the rockers 72' draw the toggle levers 50 back into the straightened position 50' again and beyond the latter into a slightly inwardly bent position shown in FIG. 2. Thus, until the movable first contact piece 10 reaches the position shown in FIG. 2, the pump piston 30 is held virtually stationary.

The arc extinguishing gas present in the surrounding space 48, in the arcing chamber 24 and in the pumping space 32 is at the same pressure in the switched-on position. If, now, in the course of a switch-off stroke the first contact pieces 10 traverses the stroke segment H, arc extinguishing gas located in the pumping space 32 is compressed and pumped through the nonreturn valve 38 into the blast chamber 24, as a result of which the blast pressure there is increased. If, now, the two contact pieces 10, 14 are separated from one another, an arc is produced between them which is blasted by means of the arc extinguishing gas which flows out of the blast chamber 24 through the blast nozzle 26.

As long as the narrowest part 28 of the blast nozzle 26 still projects over the second contact piece 14, the arc extinguishing gas can now essentially flow out through the drive rod 12 and the second contact piece 14, as a result of which the arc is extended into these tubular parts and extinguished. If only a low current is to be switched off, the extinguishment of the arc can already be performed at a small separation of the contact pieces 10, 14. In the case of a low current, the energy generated by the arc can heat up the gas located in the blast chamber 24 only slightly, and this can contribute to, at most, only a small pressure increase. Accordingly, in the case of extinguishment of low currents, the pressure increase in the blast chamber 24 which is generated by the reduction in the pumping volume ensures virtually exclusively a flow of arc extinguishing gas which in the case of short arcing times is capable of extinguishing the arc and interrupting the current.

After traversing the stroke segment H, the first contact piece 14 is then brought together with the parts moved along with it into the switched-off position, without the need to expend further energy of the drive of the compressed gas-blast circuit breaker in order to generate blast pressure. The intensification of the bent position of the toggle lever 50 leads in this case to the pump piston 30 moving in the switched-off direction O and doing so approximately at the same speed as the first contact piece 10.

If high currents such as, for example, short-circuit currents, are to be interrupted, after separation of the contact pieces 10, 14 an arc is produced whose energy is capable of heating up the arc extinguishing gas located in the blast chamber 24, and thus of contributing to a substantial pressure increase. As soon as the pressure in the blast chamber 24 is equal to or greater than that in the pumping space: 32, the nonreturn valve 38 closes. Since, however, the reduction in the pumping volume is virtually terminated at the instant of contact separation, the pressure increase generated in the blast chamber 24 by the heating has no reaction on the drive of the compressed gas-blast circuit breaker. The large overpressure in the blast chamber 24 generated by pumping from the pumping space 32 into the blast chamber 24 and by heating up by the arc is capable of generating a flow of arc extinguishing gas which is so intense that high currents can be easily interrupted without there being a need in the process for more drive energy than for switching off low currents.

If the narrowest point 28 of the blast nozzle 26 has moved away from the stationary second contact piece 14, the arc can be blasted very intensely through the narrowest point 28 of the nozzle as far as extinguishment.

It is entirely permissible for the reduction in the volume of the pumping space 32 not to be terminated until shortly after separation of the contact pieces 10, 14. In the so far only very short burning time of the arc, and given the correspondingly short arc lengths, the energy dissipated by the arc is capable of increasing the pressure in the blast chamber 24 only imperceptibly, and for this reason virtually no extra work is required from the drive mechanism of the compressed gas-blast circuit breaker, even in this case.

In the case of a switch-on stroke, the pump piston 30 is moved positively, like the first contact piece 10 and the pump cylinder 18, in the switching-on direction I, until the straightened position 50' of the toggle levers 50 is reached, and this approximately coincides with the touching of the two contact pieces 10, 14. In the case of the increase in the volume of the pumping space 32 which starts approximately at this position and lasts until the switched-on position is reached, the pumping space 32 is refilled with the arc extinguishing gas, for example SF6, through the ventilating valve 46.

It is, of course, also possible to achieve movement curves other than those shown in FIG. 5 by changing the active length of the members 58, 64 and of the rocker 72', as well as by displacing the fulcrum studs 56 and 66, by changing the overlap U of the contact pieces 10 and 14, and displacing the joint shaft 70. It remains essential that the pump piston 30 maintains its position at least approximately while the movable first contact piece 10 traverses a stroke segment H starting with the switched-on position, and the reduction in the pumping volume is essentially also terminated when the end of this stroke segment H is reached, the end of the stroke segment H having to be selected such that the reaction of the arc on the pressure in the blast chamber 24 is still negligible. It is thus also conceivable that the stroke segment H is shorter than the overlap U of the contact pieces 10, 14 in the switched-on position.

The reduction in the volume of the pumping space 32 to approximately zero leads to optimum use of the drive energy, since then only little energy remains stored in the small, compressed amount of arc extinguishing gas remaining in the pumping space 32.

The rocker need not necessarily act on the toggle lever 50, it could also be pivoted to the first or second member 58, 64 of the toggle lever 50.

I claim:

1. A compressed gas-blast circuit breaker having first and second coaxially arranged contact pieces which engage one another in a switched-on position, said first contact piece being movable in an axial direction and being surrounded by a blast nozzle which in the switched-on position, is penetrated by the second contact piece, said blast nozzle being arranged on a pump cylinder which moves along with the first contact piece, said blast nozzle being fluidly connected to a blast chamber of constant volume which contains arc extinguishing gas surrounded by said pump cylinder, said circuit breaker having a pumping space which is surrounded by the pump cylinder and fluidly connected to the blast chamber via a nonreturn valve, said pumping space having a volume which is variable by a pump piston, said pump piston being arranged in the pump cylinder such that upon movement of the first contact piece through a stroke segment of a switch-off stroke beginning at the switched-on position and ending at least approximately at a contact-separating position where contact between the first and second contact pieces terminates it causes arc extinguishing gas to be pumped through the nonreturn valve into the blast chamber for the purpose of building up blast pressure, said circuit breaker further comprising at least one toggle lever, said at least one toggle lever having a first member and a second member, said first member being pivotally connected to the pump piston, said second member being pivotally connected to a stationary support, said first and second members being pivotally connected to one another at a toggle joint in such a way that during a switch-off stroke the pump piston initially remains substantially stationary for the purpose of reducing the volume of the pumping space and there after moves in the same direction as the pump cylinder, wherein said at least one toggle lever is guided by at least one guide member which is coupled to the first contact piece such that in said course of the switch-off stroke the at least one toggle lever is initially straightened from an inwardly bent position to a straightened position, then bent from the straightened position to an outwardly bent position, then straightened back to said straightened position and bent inwardly again.

2. The compressed gas-blast circuit breaker as claimed in claim 1, wherein said at least one toggle lever is arranged such that the straightened position is achieved for a second time during each switch-off stroke at approximately when the contact-separating position is achieved.

3. The compressed gas-blast circuit breaker as claimed in claim 1, wherein said at least one guide member is a rocker having one end pivotally connected to a point which moves along with the first contact piece, and another end pivotally connected to said at least one toggle lever.

4. The compressed gas-blast circuit breaker as claimed in claim 3, wherein the rocker is pivotally connected to the toggle joint of the toggle lever.

5. The compressed gas-blast circuit breaker as claimed in claim 4, wherein an active length of the rocker is shorter than an overlapping length of the first and second contact pieces when in the switched-on position.

6. The compressed gas-blast circuit breaker as claimed in claim 5, wherein the active length of the rocker is 0.6 to 0.8 times the overlapping length.

7. The compressed gas-blast circuit breaker as claimed in claim 5, wherein an active length of the second member of said at least one toggle lever is 1.2 to 1.6 times larger than the active length of the rocker.

8. The compressed gas-blast circuit breaker as claimed in claim 7, wherein an active length of the first member of said toggle lever is at least twice the active length of the rocker.

9. The compressed gas-blast circuit breaker as claimed in claim 5, wherein an active length of the first member of said toggle lever is at least twice the active length of the rocker.

10. The compressed gas-blast circuit breaker as claimed in claim 1, wherein said at least one toggle lever and said at least one guide member comprises four toggle levers and guide members.

11. The compressed gas-blast circuit breaker as claimed in claim 1, wherein the straightened position of said at least one toggle lever extends at least approximately parallel to the axial direction.

12. The compressed gas-blast circuit breaker as claimed in claim 1, wherein an internal diameter of a narrowest portion of the blast nozzle corresponds at least approximately to an outer diameter of a segment of the second contact piece which penetrates the narrowest portion in the switched-on position in order to close the blast nozzle.

13. The compressed gas-blast circuit breaker as claimed in claim 1, wherein upon traversing the stroke segment, the volume of the pumping space is reduced to approximately zero.

* * * * *